United States Patent [19]

Wang

[11] Patent Number: 5,055,034

[45] Date of Patent: Oct. 8, 1991

[54] WINDPROOF CIGARETTE LIGHTER WITH DOUBLE FLAMES

[76] Inventor: Zhi-Lin Wang, Third Group of East District, Xinhe Town, Wenling County, Zhejiang Province, China

[21] Appl. No.: 557,341

[22] Filed: Jul. 25, 1990

[30] Foreign Application Priority Data

Jul. 26, 1989 [CN] China ..... 89214319.3
Apr. 14, 1990 [CN] China ..... 90204107.X

[51] Int. Cl.[5] ..... F23Q 7/12
[52] U.S. Cl. ..... 431/255; 431/347
[58] Field of Search ..... 431/255

[56] References Cited

U.S. PATENT DOCUMENTS 3,844,707 10/1974 Wormser .
3,915,623 10/1975 Wormser .
4,662,353 5/1987 Mifune ..... 431/255
4,859,174 8/1989 Zellweger ..... 431/255

FOREIGN PATENT DOCUMENTS 318215 5/1989 European Pat. Off. ..... 431/255
1564840 3/1969 France ..... 431/255

*Primary Examiner*—Carroll B. Dority
*Attorney, Agent, or Firm*—David A. Rose

[57] ABSTRACT

This invention relates to a windproof cigarette lighter with double flames, producing not only windproof type, but also a visible flame. It comprises: a housing, a gas reservoir, a gas charging valve, a gas discharging valve with discharging amount adjustable and valve opening member. A nozzle of the gas discharging valve is connected to the inlet of a burner through a first conduit. A piezoelectric igniting device is activated upon the opening of the gas discharging valve. The burner consists of a jet pump, a combustion chamber and a flame stabilizer which is composed of a central hub and at least a channel between the central hub and the wall of the combustion chamber. An igniting element is arranged on the downstream portion of the combustion chamber. A second conduit is connected to a nozzle which is located on the top center of the central hub and has its opening vertically upward. The central region of cross section of the combustion chamber is empty so that the combustible gas can be ejected upwardly without interruption. The windproof cigarette lighter with double flames of the present invention possesses not only the capability of resisting the wind, but also overcomes the shortcomings of the existing windproof lighter, i.e., when it is used in a bright environment, the user can hardly see the position of the flame. It can be used as either a general lighter with visible flame or a windproof lighter.

19 Claims, 5 Drawing Sheets

WINDPROOF CIGARETTE LIGHTER WITH DOUBLE FLAMES

TECHNICAL FIELD OF THE INVENTION

The present invention relates to a liquified combustible gas-fueled, such as butane, cigarette lighter, and more particularly, relates to a windproof cigarette lighter with double flames of which one flame is of the flameless type and the other, a visible flame, produced by the combustible gas ejected directly from a nozzle.

BACKGROUND OF THE INVENTION

The cigarette lighter which is fueled by a combustible gas stored in a liquified state and used nowadays may be classified into two categories, i.e. the general cigarette lighter and the windproof cigarette lighter. The former allows the gaseous fuel ejected from a nozzle directly burned in the air to produce a visible flame, so it is also called the cigarette lighter with visible flame. The latter has a burner in which the gaseous fuel is first mixed with the air and then burned. An igniting element made from high temperature resistant material such as platinum is mounted about the outlet of the combustion chamber at the upper portion of the burner. Since the gaseous fuel is pre-mixed with the air, it can be burned completely to produce an invisible pale blue flame but with very high temperature (to the incandescent degree), which will heat up the igniting element to a very high temperature in a very short time. Once the flame is blown out by the wind, the igniting element, still maintaining a sufficiently high temperature, can reignite the continuously ejected mixture of the combustible gas and air by catalyzing effect. Thus the windproof function is obtained. The igniting element is in actuality an uninterrupted igniting device for the continuously ejected mixture of combustible gas and air.

The burner of this kind for a windproof cigarette lighter, such as is disclosed by U.S. Pat. Nos. 3,844,707 and 3,915,623, usually includes a fuel ejecting orifice with a very small diameter (e.g. 0.05 mm) and two or four air intake holes which are located symmetrically on the wall of the downstream passage from the fuel ejecting orifice. Thus, they constitute a jet pump coaxial with the fuel ejecting orifice at the middle portion of the burner. On the rear end of the jet pump unit, there is a section of a venturi. On the other end of the burner, there is a combustion chamber coaxial with the jet pump unit and the venturi section. In the combustion chamber, a flame stabilizer is incorporated which is composed of a central hub and its peripheral openings. About the outlet of combustion chamber, there is mounted an igniting element which is made of high temperature resistant material. In U.S. Pat. No. 3,844,707 the igniting element is a stainless steel wire across the outlet of the combustion chamber. In JP No. 177891/87, and JP No. 14249/88, the igniting element is disclosed as made from a platinum solenoid, which improves the burning of combustible gas through its catalyzing effect.

As compared to the general cigarette lighter with visible flame, it is obvious that the windproof cigarette lighter has the advantage of strong capability to resist the wind. Even if the flame were blown-out by the wind, it can be reignited at once. However, as the flame produced by the burning of the mixture of combustible gas and air is not obvious, when igniting a cigarette in bright environment such as under the sunshine, the user can hardly see the position of flame, and the cigarette can hardly be put at a suitable position to be ignited. So, it is inconvenient to the user. Furthermore, the windproof cigarette lighter of this kind can not display the gracefulness and manner of an user during ignition of cigarette with a bright flaring flame.

SUMMARY OF THE INVENTION

In view of the above imperfection, the object of the present invention is to provide an improved cigarette lighter which can produce a visible flame, even if the flame were blown-out by the wind, the igniting element can reignite the combustible gas and reproduce a visible flame. Thus the lighter possesses both functions of windproof and displaying gracefulness and manner of an user during ignition of cigarette with a bright flaring flame. The object of the present invention is attained by the following way.

According to the present invention, the windproof cigarette lighter with double flames comprises an outer case, a middle sleeve, a top cover, a thumb piece and a reservoir to store the gaseous fuel. On the gas reservoir, there are mounted separately a gas charging valve, a gas discharging valve with gas discharging amount adjustable and a valve opening member. The nozzle of the gas discharging valve is connected with the inlet of the burner through a gas conduit. Furthermore, there is a piezoelectric igniting device which is activated upon the opening of the gas discharging valve. The said burner includes a fuel ejecting orifice of very small diameter (e.g. 0.05 to 0.07 mm) and several air intake holes which are located on the wall of the downstream passage from the fuel ejecting orifice. Thus a jet pump unit is formed coaxial with the fuel ejecting orifice. On the other end of the burner is a combustion chamber which is coaxial with the jet pump unit. In the combustion chamber there is incorporated a flame stabilizer which is composed of a central hub and some openings on its periphery. On the downstream portion of the combustion chamber, there is mounted an igniting element. According to the present invention, the windproof cigarette lighter has a gas conduit connected to a gaseous fuel nozzle which is located on the top center of a flame stabilizer and has its opening vertically upward. Between the central hub and said gaseous fuel nozzle there is a baffle, whose circumference and the interior wall of combustion chamber form together an annular passage for passing the gaseous fuel. Igniting elements are arranged in the vicinity of the combustion chamber wall or located symmetrically on the periphery or two opposite sides of the combustion chamber so that the central part of the cross section of combustion chamber is empty. All the said parts are assembled as a whole unit in the outer case of the lighter.

As compared with the existing windproof cigarette lighter, the windproof lighter with double flames of the present invention not only possesses the same capability to resist the wind as the existing windproof lighter, but also can produce a visible flame which provides convenience for the user when using in a bright environment, and can display the gracefulness and manner of an user during ignition of the cigarette with a bright flaring flame. Furthermore, when using in the case of no wind, the gaseous fuel conduit connected to the inlet of burner can be cut off, and the windproof lighter of the present invention can be used as the general lighter with visible flame. On the other hand, when the gaseous fuel conduit connected to the gaseous fuel nozzle to produce visible flame is cut off, then the windproof ligther of the present invention would yield the flameless effect as the existing windproof lighter.

The advantages of the present invention will become more apparent from the following description taken together with the accompanying drawings.

BRIEF DESCRIPTION OF THE DRAWINGS

The present invention will be described in detail with accompanying drawings as follows. Elements common to all the embodiments are described and illustrated using the same reference numerals.

DETAILED DESCRIPTION OF THE PREFERRED EMBODIMENTS

Figure 1:
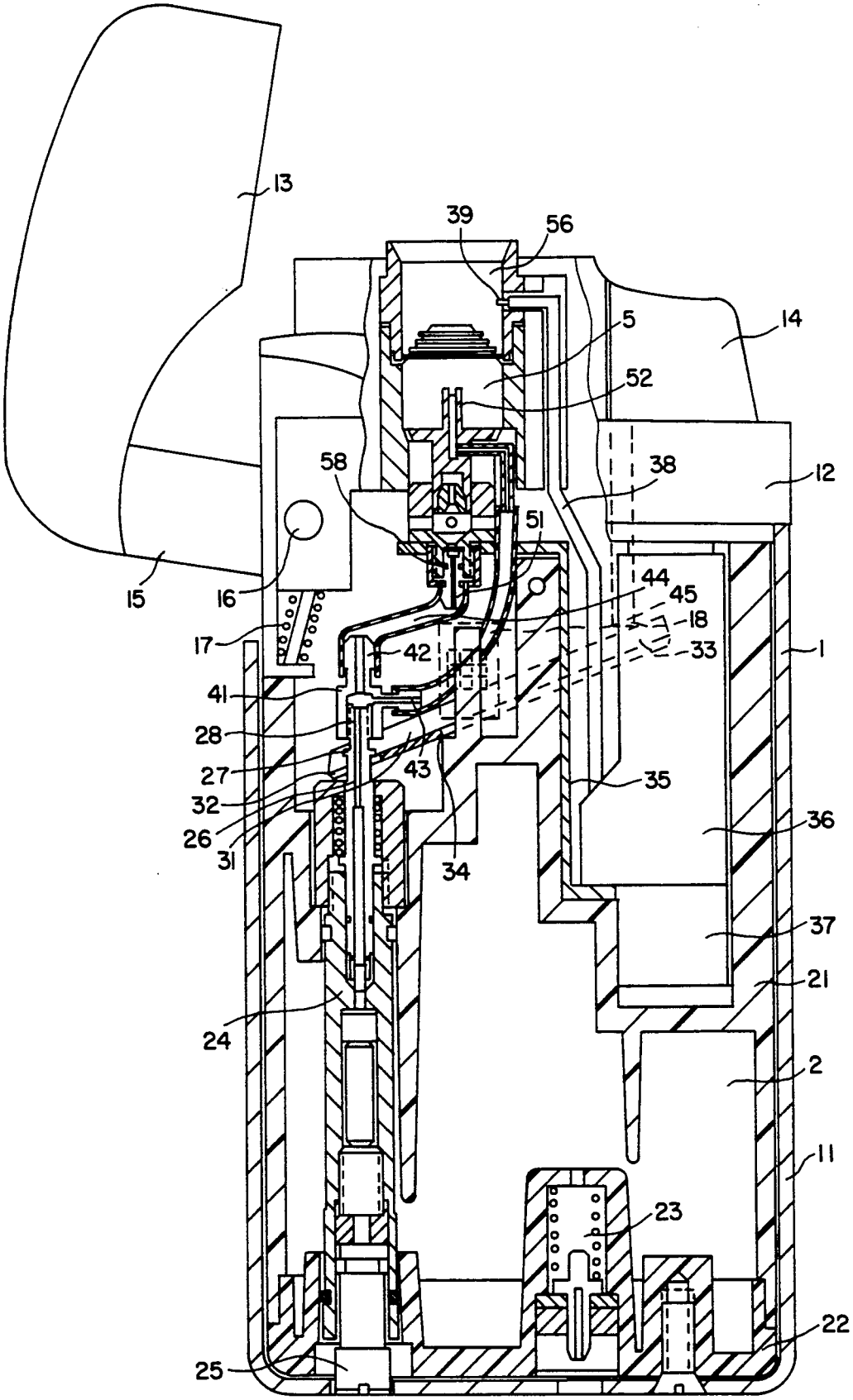
FIG. 1 is an enlarged front elevational view in partial section of one form of the embodiments of a windproof lighter with double flames according to the present invention.

Referring to the FIG. 1, according to the present invention, the windproof lighter with double flames usually includes outer case 1 which is composed of bottom shell 11, middle sleeve 12, turnup top cover 13 and thumb piece 14. The lever part 15 of top cover 13 can be turned about the pivot 16 which is inserted in the middle sleeve 12. A spring member 17 is disposed between the end of lever part 15 and the middle sleeve 12 such that the top cover 13 is either in the closed position or in the opened position. In the bottom shell 11, there is a gas reservoir 2, two parts of which, i.e. the body of gas reservoir 21 and the bottom cover 22 are joined together by adhesion or welding (ultrasonic welding). At the bottom of gas reservoir 2, there is mounted a gas charging valve 23 and on the gas reservoir 2, there is also mounted a gas discharging valve 24. The amount of gas discharged is adjustable. The adjustment is realized by turning an adjusting rod 25. On the upper portion of gas discharging valve stem 26, there is a flange ring 27 which is to be engaged with the notch 32 on the valve opening member 31. On the other end of the valve opening member 31 there are two extended arms 33. The valve opening member 31 is supported on a fulcrum 34. On the nozzle 28 at the top end of valve stem 26 there is mounted a tee joint 41. The outlets 42 and 43 of the tee joint 41 are connected to the inlet 51 of the burner 5 and the nozzle 52 for producing visible flame through gas conduit 44 and 45 respectively. The burner 5 is supported by a supporter 35, the other end of which is in contact with the metallic bottom shell 37 of the piezoelectric igniting device 36 to constitute a circuit for electric-discharge. The electrode 38 for discharge is led through the wall of combustion chamber 56 of the burner 5, with its tip 39 projected into the combustion chamber 56. When the thumb piece 14 is pressed down, the end of the extended rod 18 of the thumb piece 14 would press down the extended arm 33 of the valve opening member 31, the valve stem 26 is lifted through the fulcrum 34, and the gas discharging valve 24 is opened. The gaseous fuel passes through the discharging valve 24 and is ejected from the nozzle 28. As the thumb piece 14 is pressed down further, the piezo-electric igniting device 36 is activated to discharge from the tip 39 of discharging electrode 38, producing spark in the combustion chamber 56, which ignites the combustible gas and the mixture of combustible gas and air. Further, an adjusting device of wedge block or screw (not shown in the Figures) may be installed to adjust the amount of combustible gas through the gaseous fuel conduit.

Figure 2:
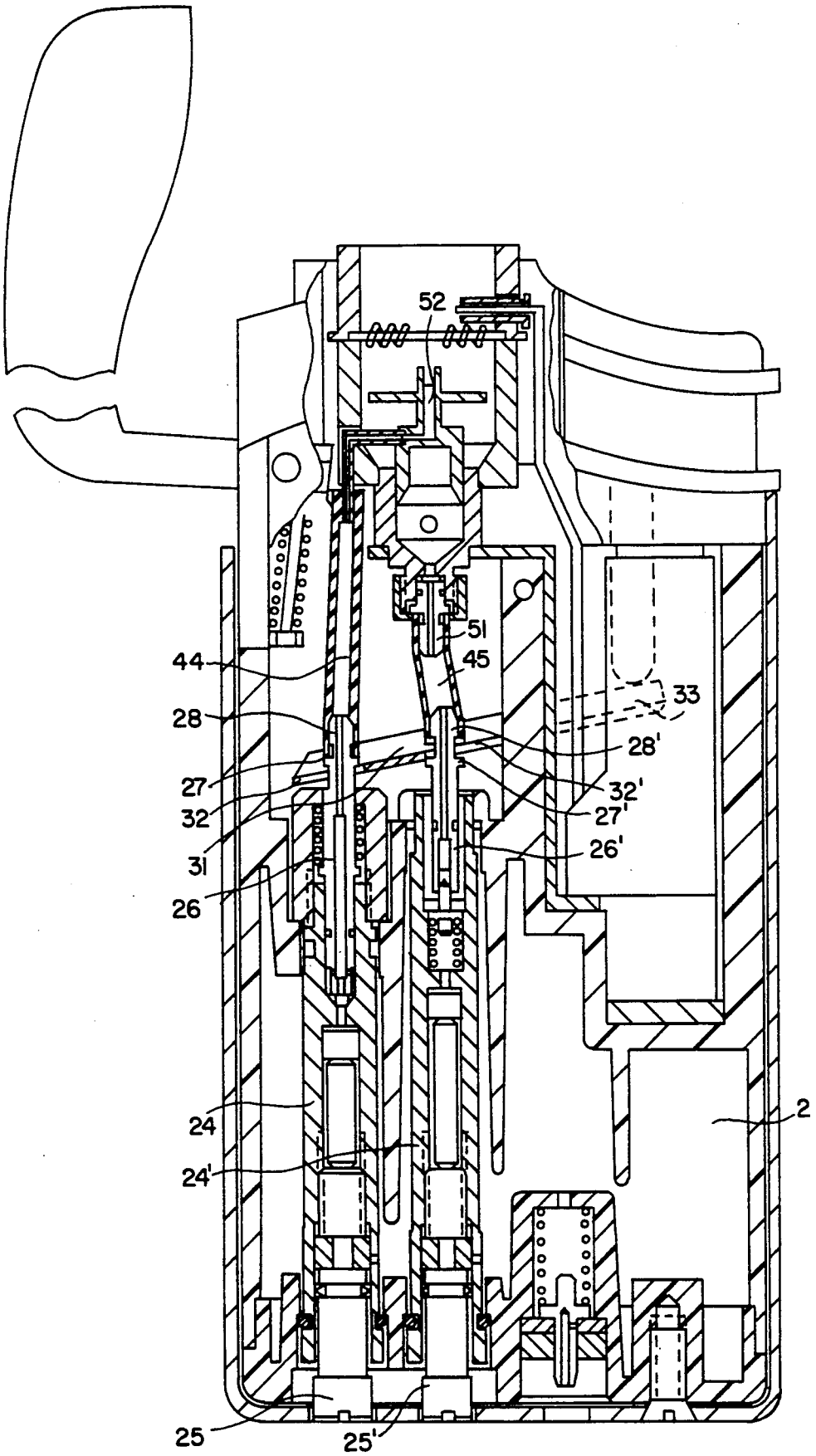
FIG. 2 is an enlarged front elevational view in partial section of another form of the embodiments of a windproff lighter with double flames according to the present invention.

Referring to FIG. 2, there are two gas discharging valves 24 and 24' mounted on the gas reservoir 2, the amount of gas discharged from these two gas discharging valves 24 and 24' can be separately adjusted by turning the respective adjusting rods 25 and 25'. The valve stems 26 and 26' of these valves both have flanges 27 and 27' at its upper portion, and at their ends are the nozzles 28 and 28' respectively.

The former is connected with the nozzle 52 to produce visible flame through conduit 44, while the latter is connected with the inlet 51 of the burner 5 through the conduit 45. The valve opening member 31 has notches 32 and 32' on its one end and middle portion respectively. Since the valve 24 is a pull-open valve and the valve 24' is a press-open valve, therefore the notch 32 is engaged with the lower face of flange 27 and the notch 32' is engaged with the upper face of flange 27'; these two flanges 27 and 27' act as fulcrums one against another. When the extended arm 33 of the valve opening member 31 is pressed down, owing to the difference in lengths of force-arm, the press-open valve 24' is opened firstly, while the pull-open valve 24 can be opened only after the valve stem 26' of the valve 24' reaches the dead point thereof.

Figure 3:
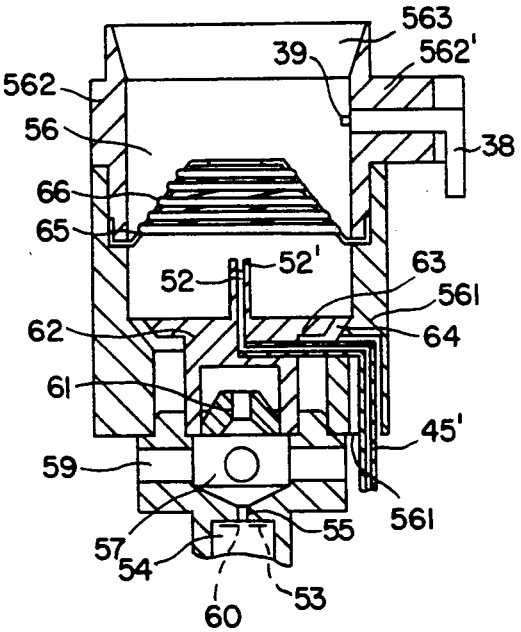
FIG. 3 is an enlarged front elevational section view of one form of burner of a windproof lighter with double flames according to the present invention.
Figure 4:
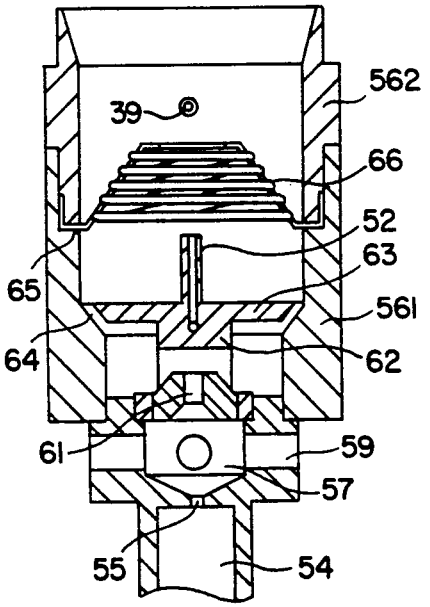
FIG. 4 is a side elevational section view of FIG. 3.

Referring to FIG. 3 and FIG. 4, according to the present invention, the burner of the windproof lighter with double flames includes a fuel ejecting orifice 60 with a very small diameter (e.g. 0.05 mm). The fuel ejecting orifice 60 may be an orifice of very small diameter punched out from a thin sheet 53, and the thin sheet 53 is then put into a counterbore 54 and pressed tightly by a press-block 58 (FIG. 1) with a through hole in its center and the inlet 51 of burner 5 at its bottom. At the bottom of counterbore 54, there is a through hole 55 connecting to a cavity 57. On the wall of cavity 57 are located several (e.g. two or four) air intake holes 59, thus constituting a jet pump unit coaxial with the fuel ejecting orifice 60. On one end of the jet pump is a section of venturi 61, whose function is to stabilize the mixture of combustible gas and air entering the combustion chamber 56 by decreasing its velocity and increasing its pressure. On the downstream region of the venturi 61 is a flame stabilizer 62 of crossbar shape. At the top center of the flame stabilizer 62 there is a combustible gas nozzle 52 used to produce visible flame. The flame stabilizer 62 includes a baffle 63 is set between the body of the flame stabilizer 62 and the nozzle 52. The baffle 63 and the peripheral wall of the lower portion 561 of the combustion chamber 56 form an annular passage between them. On the lower portion 561 of the combustion chamber 56 there is a slot 561' used to place the intermediate conduit 45' of L shape, whose lower end is connected with the conduit 45 in FIG. 1 and its end of horizontal segment end is connected to the nozzle 52. A supporting bracket 65 for igniting element is clamped between the upper portion 562 and the lower portion 561 of the combustion chamber 56. On the bracket is wound an igniting element 66 made from platinum wire. On the wall of upper portion 562 there is a boss 562' with hole used to place the discharging electrode 38, whose tip 39 is projected somewhat into the combustion chamber 56. A discharging gap is formed between the tip 39 and the igniting element 66 with its supporter 65. When the piezoelectric igniting device 36 in FIG. 1 is activated, electric spark can be produced between the tip 39 and the igniting element 66 with its supporter 65, igniting the mixture of combustible gas and air ejected from the annular passage 64 and ascending along the peripheral wall of the combustion chamber 56. Since the upper portion 562 and the lower portion 561 are all made from electric insulating and refractory material such as ceramics and the electrical capacity of the igniting element 66 with its supporter 65 is limited, therefore the second spark can be produced between the igniting element 66 with its supporter 65 and the nozzle 52 for generating a visible flame, igniting the combustible gas ejected from the nozzle 52. Of course, the burned mixture of combustible gas and air may also ignite the combustible gas ejected from the nozzle 52. The baffle 63 serves the functions of, firstly, making the uniform distribution of the mixture of combustible gas and air ejected from both sides of cross bar of the flame stabilizer 62 along the peripheral wall of combustible chamber 56; secondly, enabling the above mentioned gas mixture to flow upwards closing to the peripheral wall of combustion chamber 56, hence the disturbance to visible flame produced by combustible gas ejected from nozzle 52 can be avoided. In order to attain better effect, it is preferred that the lower portion of combustion chamber 56 corresponding to the baffle 63 and the peripheral face of the baffle 63 are all made conical to form a conical annular passage 64. In order to improve the reliability to ignite the combustible gas ejected from the nozzle 52, two symmetrically arranged short slots 52' can be made on the nozzle 52. The object of making the peripheral face conical at the outlet 563 of combustion chamber 56 is to promote the reignition of the mixture of combustible gas and air by the igniting element 66 when the flame is blown out by the wind, further to improve the ignition speed of the combustible gas ejected from the nozzle 52.

Figure 5:
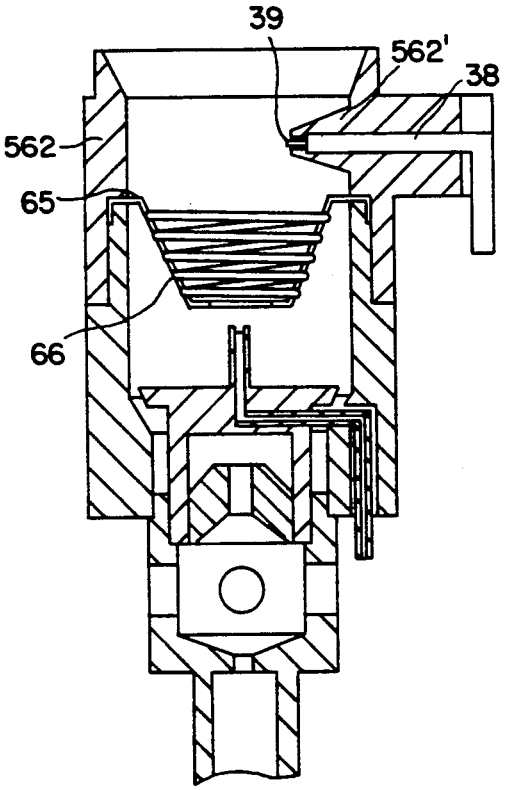
FIG. 5 is an enlarged front elevational section view of the second form of burner of a windproof lighter with double flames according to the present invention.
Figure 6:
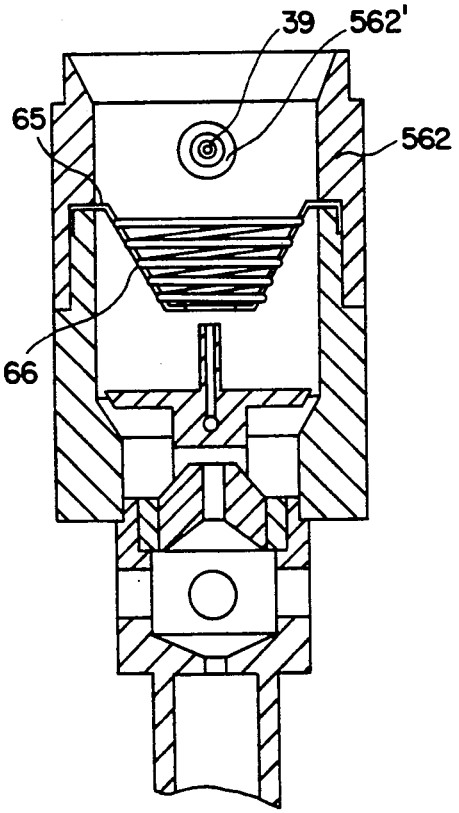
FIG. 6 is a side elevational section view of FIG. 5.

Referring to FIG. 5 and FIG. 6, the structure of the burner is distinguished from that shown in FIG. 3 and FIG. 4 in that the igniting element 66 and its supporter 65 is inverted. The tip 39 of the discharging electrode projected somewhat more into the combustion chamber 56. For supporting the electrode 38, a conical boss 562 is also required. The inverted igniting element 66 and its supporter 65 can make the visible flame produced even more stable, and the projection of the tip 39 of discharging electrode into the combustion chamber 56 is to make the position of discharging gap more adequately.

Figure 8:
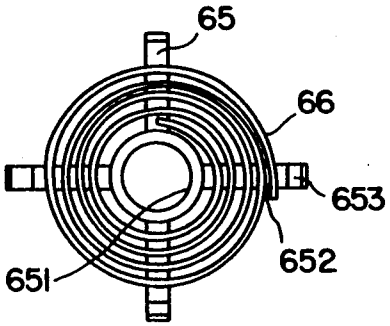
FIG. 8 is a top view of FIG. 7.
Figure 7:
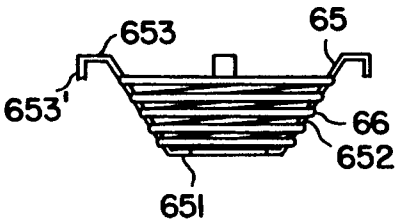
FIG. 7 is an enlarged front elevational view of the igniting element and its supporter in the burners as shown in FIG. 3–FIG. 6.

Referring to FIG. 7 and FIG. 8, these are structural drawings of the igniting element and its supporter in the burners as shown in FIG. 3–FIG. 6. The supporting bracket 65 includes a central ring 651 and several (e.g. four) legs 652 inclined relative to the ring plane with its one end located on the outer periphery of the ring 651, and a segment of its another end bent into flange 653 parallel to the ring 651. The flange is used to be clamped in position between the upper portion 562 and the lower portion 561 of the combustion chamber. In order to make a reliable clamping, the end of the flange 653 can be further bent into a short vertical flange 653'. There are small notches cut out on the supporting leg 652 for hanging the igniting element 66 which is wound on the supporting leg 652 to form a conical configuration or of near by a four lateral pyramid. The center of the central ring 651 is empty, so that the combustible gas ejected from the nozzle 52 can produce visible flame uninterrupted.

Figure 9:
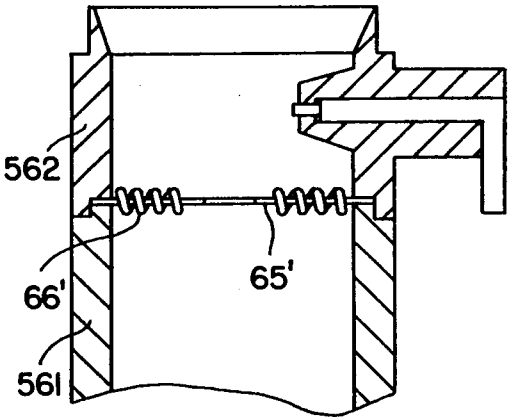
FIG. 9 is a partly enlarged front elevational section view of the third form of burner of a windproof lighter with double flames according to the present invention.
Figure 10:
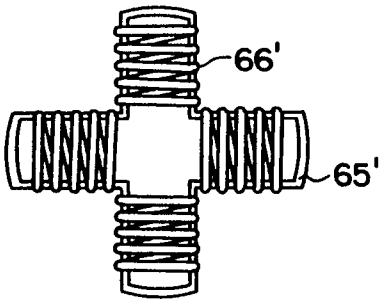
FIG. 10 is an enlarged top view of the ignition element and its supporter in the burner as shown in FIG. 9.

Referring to FIG. 9 and FIG. 10, as compared with the structures shown in FIG. 5–FIG. 8, the distinction lies only in the difference of shape and structure for the igniting element 66' and its supporter 65'. The supporter 65' is made of four U-shaped supports interconnected end to end together forming a cross-shaped bracket. The igniting elements 66' are wound around each U-shaped support. The arms of the U-shaped support can also be cut with small notches to prevent the igniting element from deformation. In order to maintain a sufficient heat capacity, the igniting elements should be connected in pairs, i.e. using one platinum wire wound on two neighboring U-shaped supports. The cross-shaped supporting bracket and the igniting elements 66' wound on it are clamped together between the upper portion 562 and the lower portion 561 of the combustion chamber. Obviously, the igniting element and its supporter of this kind is easily made and assembled.

Figure 12:
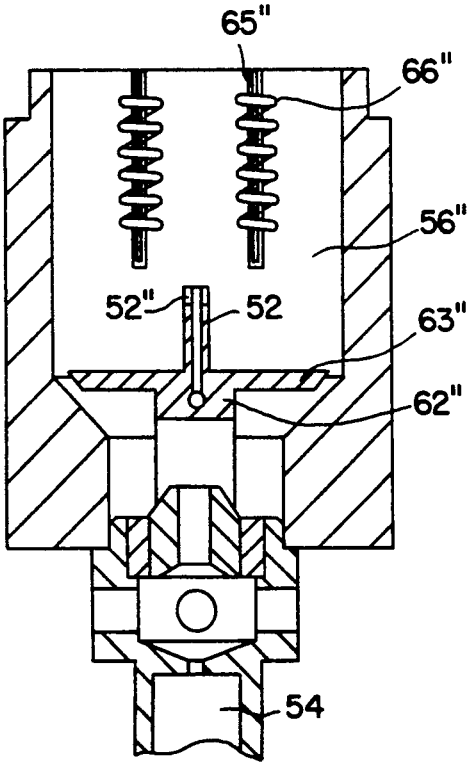
FIG. 12 is a top section view of FIG. 11.
Figure 13:
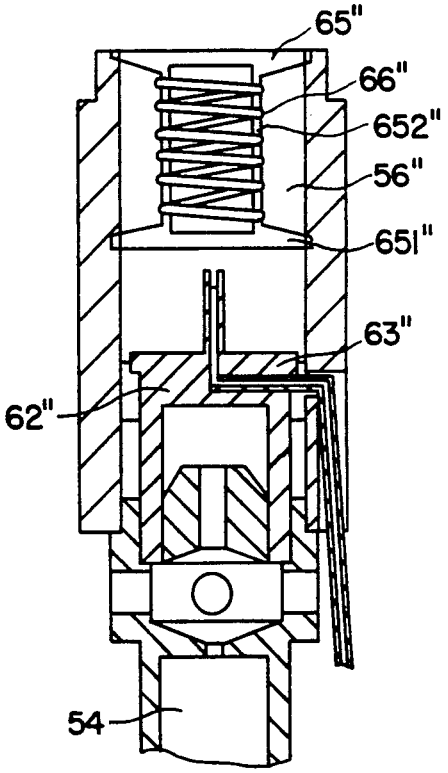
FIG. 13 is a side section view of FIG. 12.
Figure 11:
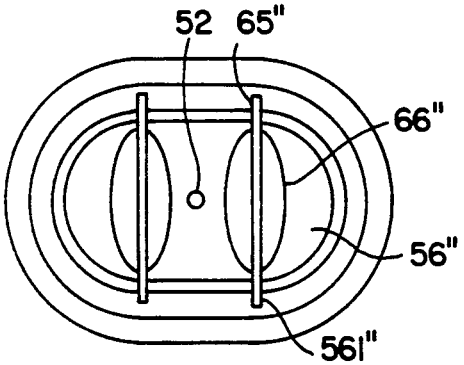
FIG. 11 is an enlarged top view of the fourth form of burner of a windproof lighter with double flames according to the present invention.

Referring to FIG. 11–FIG. 13, as compared with the structures shown in FIG. 3–FIG. 10, the distinction lies in the cross sectional shape and their arrangement of the combustion chamber, the igniting elements and supporters in the combustion chamber. The cross section of the combustion chamber 56'' as shown is an oval shape. Here the combustion chamber is an integral structure and the opening at the lower portion is still a circle. In order to match the shape of combustion chamber, the baffle 63'' is also made in approximately oval shape. The supporter 65'' has a structure of frame shape with four extended legs 651''. The igniting element 66'' is wound around the frame part 652'', small notches can also be cut out on the frame part 652''. On the inside wall of combustion chamber 56'' there are four longitudinal grooves 561'' located symmetrically, used for inserting two sets of igniting element and their supporters, in which the igniting element 66'' is wound around the supporting bracket 65'' into a spiral shape of elliptical cross section. After inserting into the combustion chamber 56'', the longer axis of igniting element 66'' is perpendicular to the longer axis of cross section of combustion chamber 56'', the longer axis of cross bar of the flame stabilizer 62'' is also perpendicular to the longer axis of cross section of combustion chamber 56''. The electrode 38 in FIG. 1 is wound around the outer periphery of the counterbore 54, so that the nozzle 52 serves as a discharging electrode and the igniting element 66" with its supporter 65" act as the second discharging electrode. In order to improve the reliability of ignition, two symmetrical short slots 52" with its direction parallel to the longer axis of combustion chamber 56 can be cut out on the nozzle 52.

In the structures shown in FIG. 3–FIG. 10, if the tip 39 of discharging electrode is put between the igniting element 66 and the nozzle 52, the same expected object can be attained.

During operation, firstly, turn up the top cover 13, press down the thumb piece 14 by finger, then the end of extended rod 18 of the thumb piece 14 would press down the extended arm 33 of the valve opening member 31. Through the fulcrum 34, the valve stem 26 is lifted and the valve 24 is opened. The gaseous fuel passing through the gas discharging valve 24 is ejected from the nozzle 28 and is divided into two parts by the tee joint 41 mounted on the nozzle 28. One part of gaseous fuel is emitted from the outlet 42 of tee joint 41, along the gaseous fuel conduit 44, reaches the inlet 51 of the burner 5. While the other part of gaseous fuel is emitted from the other outlet 43 of the tee joint 41, through the conduit 45, reaches the nozzle 52 which produces visible flame and is ejected from the nozzle 52. The gaseous fuel entering the burner 5 is ejected with high speed from the fuel ejecting orifice 60, forming a current of high speed gas stream with a shape like a straight line. The gas stream hits on the cross bar of the flame stabilizer 62 and is dispersed, mixed with the air which is aspirated from the air intake holes 59 on the wall of the cavity 51, then the mixture of gaseous fuel and air is ejected from the two sides of cross bar of flame stabilizer 62. Owing to the function of baffle 63, the mixture of combustible gas and air can flow upward only along the periphery of combustion chamber 56. At last, there is a current of combustible gas in the center, while on the periphery there is a ring of mixture of combustible gas and air. As the thumb piece 14 is pressed down further, the piezoelectric igniting device 36 is activated, and the electricity is discharged from the tip 39 of the discharging electrode 38 toward the igniting element 66 and its supporter 65. The electric spark produced firstly ignites the mixture of combustible gas and air. As the electric-capacity of the igniting element 66 and its supporter 65 is limited, so the second spark is produced between the igniting element 66 with its supporter 65 and the gaseous fuel nozzle 52. The gaseous fuel ejected from the nozzle 52 is ignited by that spark and by the already burned mixture of combustible gas and air as well.

In the case of using two gas discharging valves 24 and 24', when the thumb piece 14 is pressed down, the end of its extended rod 18 would press down the extended arm 33 of the valve opening member 31. As the force-arm of press-open valve 24' is shorter than that of the pull-open valve 24, so the press-open valve 24' is opened at first. The pull-open valve 24 can be opened only after the valve stem 26' of the press-open valve 24' reaches its dead point. The gaseous fuel ejected from the nozzle 28' of the press-open valve 24' passes through the conduit 45, and reaches the inlet 51 of the burner 5. While the gaseous fuel ejected from the nozzle 28 of the pull-open valve 24 passes through the conduit 44, reaches the nozzle 52 and is ejected from that nozzle. Other situations are the same as described in the above.

As various modifications could be effected on the basic conception of the above constructions without departing principally from the scope of the present invention. It should be understood that all matters contained therewith in the above description or shown therewith in the accompanying drawings shall be interpreted as illustrative and not representing a limiting sense.

What is claimed is:

1. A windproof cigarette lighter with double flames comprising:

a housing; a reservoir to store the gaseous fuel; a gas charging valve mounted on said reservoir; a gas discharging valve whose gas discharging amount is adjustable and a valve opening member; a nozzle of said gas discharging valve being connected to the inlet of a burner through a gaseous fuel conduit; a piezoelectric igniting device which is activated upon the opening of said gas discharging valve; said burner including a jet pump, a flame stabilizer and a combustion chamber; said jet pump having a fuel ejecting orifice at its inlet portion and a plurality of air intake holes on the wall of a downstream passage extending from said fuel ejecting orifice; said combustion chamber coaxial with said jet pump unit being on the other end of said burner; said flame stabilizer forming a channel with the wall of the lower part of the combustion chamber; an igniting element being arranged on the downstream portion of said combustion chamber for reigniting the gaseous air/fuel mixture; wherein the improvement comprises:

a second gas conduit being connected to a gaseous fuel nozzle which is located on the top center of said flame stabilizer and has an opening directed vertically upward for producing visible flame; and said igniting element being arranged in the vicinity of the wall of said combustion chamber, the central region of cross section of said combustion chamber being empty, so that the combustible gas can be ejected upwardly without interruption.

2. A windproof cigarette lighter with double flames as set forth in claim 1, further including one gas discharging value which is connected with said nozzle for producing visible flame through a second gas conduit.

3. A windproof cigarette lighter with double flames as set forth in claim 1, further including a tee joint mounted on the nozzle of said gas discharging valve, one of the outlets being connected to the inlet of said burner through a gas conduit, and the other outlet being connected through a second gas conduit to the nozzle at the top center of said flame stabilizer and with an opening vertically upward.

4. A windproof cigarette lighter with double flames as set forth in any one of claims 1 and 3, wherein a discharging electrode of said piezoelectric igniting device is projected through the wall of said combustion chamber which is made from an electric-insulating and refractory material and the tip of said discharging electrode is projected into said combustion chamber at a downstream position of said igniting element and a supporter for said igniting element, a first discharging gap being formed between the tip of said discharging electrode and said igniting element with its supporter, and a second discharging gap being formed between said igniting element with its supporter and said nozzle at the top center of said flame stabilizer with its opening vertically upward.

5. A windproof cigarette lighter with double flames as set forth in claim 4, wherein the supporter of said igniting element comprises a central ring and a plurality of legs which are stretched out from the periphery of said central ring, inclined relative to the ring plane, with its other end bent into a segment of a flange parallel to said ring plane, small notches being cut out on each leg, said igniting element being wound on its supporter to form a conical configuration.

6. A windproof cigarette lighter with double flames as set forth in claim 5, said combustion chamber has an upper portion and a lower portion, wherein a flange formed at the outer end of the supporter for said igniting element is clamped between the upper and lower portions of said combustion chamber, and the conical shape of said igniting element is with its small end at the downstream position of said combustion chamber.

7. A windproof cigarette lighter with double flames as set forth in claim 5, said combustion chamber has an upper portion and a lower portion, wherein the flange formed at the outer end of the supporter for said igniting element is clamped between the upper and lower portions of said combustion chamber, and the conical shape of said igniting element is with its large end at the downstream position of said combustion chamber.

8. A windproof cigarette lighter with double flames as set forth in claim 5, wherein the supporter of said igniting element is made of four U-shaped supports which are interconnected end to end together forming a cross-shaped bracket, said igniting elements being wound around each U-shaped support and two neighboring igniting elements being connected together in pairs.

9. A windproof cigarette lighter with double flames as set forth in claim 4, wherein the cross section of said combustion chamber is an oval shape having a longitudinal and transverse axis and the baffle is an approximately oval shape having a longitudinal and transverse axis, said igniting elements being wound around two supporting frames with four extended legs into a spiral shape of elliptical cross section, said supporting frames with said igniting element wound being inserted into grooves symmetrically cut out of an inner wall of said oval combustion chamber, said longitudinal axis of said igniting element being parallel with said transverse axis of said combustion chamber.

10. A windproof cigarette lighter with double flames as set forth in claim 1, wherein said flame stabilizer includes a crossbar located at a down stream position from the jet pump.

11. A windproof cigarette lighter with double flames as set forth in claim 1, wherein the lower wall of said combustion chamber corresponding to said flame stabilizer and a peripheral face of said flame stabilizer being frustoconical to form a conical annular passage.

12. A windproof cigarette lighter with double flames as set forth in claim 1, further including two short slots cut out on the outlet of said gaseous fuel nozzle.

13. A windproof cigarette lighter with double flames as set forth in claim 1, wherein the peripheral face of an inner wall at the outlet of said combustion chamber is conical.

14. A windproof cigarette lighter with double flames as set forth in claim 1, wherein said flame stabilizer including a baffle with the circumference of said baffle and the wall of said combustion chamber form a passage.

15. A cigarette lighter operating on compressed gaseous fuel stored in a reservoir, comprising:

first and second conduits communicating with the reservoir;

valve means for opening and closing said first and second conduits to the flow of gaseous fuel therethrough;

a combustion chamber;

a nozzle projecting into said combustion chamber;

said second conduit in flow communication with said nozzle to discharge gaseous fuel from said nozzle for producing visible flame;

a fuel ejecting orifice in flow communication with said first conduit and directing the gaseous fuel into a passage for the mixing of air and gaseous fuel;

said passage extending from said fuel ejecting orifice having at least one air intake hole and an exit port forming a jet pump;

said jet pump communicating through a flame stabilizer with said combustion chamber and directing the air/gaseous fuel mixture into said combustion chamber;

an igniting element disposed within said combustion chamber for reigniting the air/gaseous fuel mixture;

the gaseous fuel ejecting from said nozzle producing a first visible flame; and the air/gaseous fuel mixture from said passage producing a second invisible flame.

16. The cigarette lighter of claim 15 wherein said flame stabilizer includes a central hub and a baffle disposed between said central hub and said gaseous fuel nozzle.

17. The cigarette lighter of claim 15 wherein said igniting element includes a coiled wire suspended within said combustion chamber.

18. The cigarette lighter of claim 17 wherein said coiled wire has a conical shape with an apex.

19. The cigarette lighter of claim 15 wherein said valve means includes a tee communicating with the first and second conduit.

* * * * *